US010449583B2

(12) United States Patent
Charre et al.

(10) Patent No.: US 10,449,583 B2
(45) Date of Patent: Oct. 22, 2019

(54) SPRAY DEVICE FOR ROLLING EQUIPMENT AND METHOD FOR REMOVING/INSERTING SAID SYSTEM FROM/INTO SAID ROLL STAND

(71) Applicant: PRIMETALS TECHNOLOGIES AUSTRIA GMBH, Linz (AT)

(72) Inventors: Francis Charre, Balbiny (FR); Patrick Clavelloux, Verrieres en Forez (FR)

(73) Assignee: Primetals Technologies Austria GmbH, Linz (AT)

( * ) Notice: Subject to any disclaimer, the term of this patent is extended or adjusted under 35 U.S.C. 154(b) by 514 days.

(21) Appl. No.: 14/410,182

(22) PCT Filed: May 3, 2013

(86) PCT No.: PCT/EP2013/059229

§ 371 (c)(1),
(2) Date: Dec. 22, 2014

(87) PCT Pub. No.: WO2013/189657

PCT Pub. Date: Dec. 27, 2013

(65) Prior Publication Data

US 2015/0336146 A1 Nov. 26, 2015

(30) Foreign Application Priority Data

Jun. 22, 2012 (EP) ..... 12290204

(51) Int. Cl.
*B21B 13/14* (2006.01)
*B21B 27/10* (2006.01)
(Continued)

(52) U.S. Cl.
CPC ..... *B21B 27/10* (2013.01); *B21B 45/0218* (2013.01); *B21B 45/0233* (2013.01);
(Continued)

(58) Field of Classification Search
CPC . B21B 45/02; B21B 45/0203; B21B 45/0209; B21B 45/0215; B21B 45/0218;
(Continued)

(56) References Cited

U.S. PATENT DOCUMENTS 2,067,514 A * 1/1937 Trinks ..... B21B 45/02 29/17.2
3,646,790 A * 3/1972 Properzi ..... B21B 31/08 72/201

(Continued)

FOREIGN PATENT DOCUMENTS

CN 201579274 U 9/2010
DE 2652211 A 5/1978

(Continued)

*Primary Examiner* — Gregory D Swiatocha
(74) *Attorney, Agent, or Firm* — Laurence A. Greenberg; Werner H. Stemer; Ralph E. Locher

(57) ABSTRACT

A spray device lubricates and cools a strip and/or an air gap of a roller stand having multiple rollers. The spray device has a fixed spray table with an elongated shape and configured to be rigidly connected to a plurality of mounting plates in a row of bearing rollers of the roller stand. The fixed spray table includes a network for dispensing a fluid for lubricating and cooling via a plurality of nozzles, a connector for connecting the fluid-dispensing network to a network for supplying the fluid, and an attachment device for rigidly connecting the table to the mounting plates. In addition, a method for removing/inserting the spray device from/into the roller stand is described.

11 Claims, 5 Drawing Sheets

(51) Int. Cl.
*B21B 29/00* (2006.01)
*B21B 45/02* (2006.01)

(52) U.S. Cl.
CPC ..... *B21B 45/0251* (2013.01); *B21B 13/147* (2013.01); *B21B 29/00* (2013.01); *B21B 2027/103* (2013.01)

(58) Field of Classification Search
CPC ..... B21B 45/0233; B21B 45/0239; B21B 45/0245; B21B 45/0248; B21B 45/0251; B21B 27/06; B21B 27/10; B21B 2027/103
USPC ..... 72/201, 236; 492/46
See application file for complete search history.

(56) References Cited

U.S. PATENT DOCUMENTS 3,998,084 A * 12/1976 Rerecich ..... B21B 45/0218 266/134
4,248,073 A * 2/1981 Verbickas ..... B21B 13/147 72/243.4
4,706,480 A * 11/1987 Svatos ..... B21B 37/32 72/11.4
4,706,485 A * 11/1987 Gilvar ..... B21B 13/005 72/201
5,558,017 A 9/1996 Berger et al.
6,116,073 A 9/2000 Kajiwara et al.
6,185,973 B1 2/2001 Hayashi et al.
6,598,448 B1 * 7/2003 Barten ..... B21B 27/10 72/201
9,039,956 B2 * 5/2015 Matsumoto ..... B21B 39/16 266/46
2001/0007200 A1 * 7/2001 Ravenet ..... B21B 27/10 72/236
2011/0278367 A1 * 11/2011 Cronier ..... B21B 27/10 239/1
2012/0031159 A1 * 2/2012 Seidel ..... B21B 27/10 72/6.2

FOREIGN PATENT DOCUMENTS

DE 4406454 C1 2/1994
JP S60244411 A 12/1985
JP S61253101 A 11/1986
JP 2003080312 A 3/2003
JP 2010094704 A 4/2010

* cited by examiner

SPRAY DEVICE FOR ROLLING EQUIPMENT AND METHOD FOR REMOVING/INSERTING SAID SYSTEM FROM/INTO SAID ROLL STAND

BACKGROUND OF THE INVENTION

Field of the Invention

The present invention relates to a spray device suitable for equipment for rolling metal strips in motion, and a method for removing/inserting said spray and guidance device from/into said roll stand, according to the preamble of the main claims.

In particular, the invention relates to the lubrication and cooling of the metal strip and elements associated with the cold-rolling of said continuously or reversibly moving strip in at least one roll stand or rolling mill in rolling equipment. In particular, said elements make reference to a set of stacked rolls having parallel longitudinal axes placed approximately in at least a single plane perpendicular to the direction of travel of the strip. The longitudinal axis of one of said rolls is defined as an instantaneous axis of rotation, parallel to a generating line of the roll and passing through the center of mass of said roll. More particularly, the present invention concerns the rolling of certain metal alloys requiring the use of small-diameter rolling rolls, such as for example stainless steels, silicon steels, or even certain non-ferrous alloys. These metal alloys are rolled in equipment comprising at least one roll stand with multiple rolls such as, for example, rolling mills of the 12-High or 20-High type, i.e. fitted with 12 or 20 rolls.

As is known, small-diameter rolling rolls in a roll stand do not have sufficient rigidity to withstand the rolling forces without bending. They are therefore held in the roll stand by rolls and bearing or support rolls. A typical example of a 20-High rolling mill is presented in FIG. 1. This is made up of an upper assembly of ten rolling rolls and a lower assembly of ten rolling rolls, each of the assemblies comprising, in a pyramid or stack structure, a working roll 3, 3' in contact with the strip 2 to be rolled and supported by two intermediate bearing rolls 4, 4', themselves supported by three intermediate bearing rolls 5, 5*a*, 5', 5'*a*, themselves supported by four rows of bearing rolls 6, 6', each row of bearing rolls being made up of a plurality of bearing rolls and mounting plates mounted alternating on a single roll-bearing shaft, each bearing roll being in particular edged by two mounting plates. Each row of bearing rolls 6, 6' is also positioned and fixed to the frame 1 of the roll stand by means of said mounting plates 7, which provide for take-up of the forces resulting from rolling by the working rolls 3, 3', and for positioning of the rows of bearing rolls 6, 6' they support with respect to said frame 1 of the roll stand.

In order to facilitate the movement and rolling of the strip 2 between the working rolls 3, 3', the air gap of the rolls in cold-rolling mills is sprayed and lubricated. For this purpose, lubricant fluid is sprayed onto the strip to be rolled and onto the surface of the working rolls. In certain cases, the spray fluid also plays an important role in the evacuation of heat produced in the air gap of the rolls by the reduction of the strip and its plastic deformation. It is thus current practice, in cold-rolling, to cool the working rolls by spraying under pressure with a cooling and lubricating spray fluid. Generally, systems comprising spray nozzles make it possible to spray at least a part of the strip or a part of the rolls with said cooling and lubricating spray fluid.

In the case of a rolling mill of the traditional duo, quarto or sexto type, working rolls can easily be sprayed, since the accessibility of the rolls and the strip is excellent. On the other hand, the very compact design of multi-roll rolling mills, in particular of the 12- or 20-High type, is such that the space available for a spray device for the working rolls is very restricted. Nonetheless, spray devices providing for spraying of the strip and working rolls are known to a person skilled in the art, such as for example for a 20-High rolling mill. In fact, with reference to FIG. 1, such a spray device comprises in particular spray tables 11, 11', 12, 12' comprising a fixed part 11A, 11A', 12A, 12A', known as a fixed table and mounted cantilevered, rigidly connected to the frame 1 of the roll stand, and comprising spray nozzles essentially intended to spray the strip 2, and an articulated part 11B, 11B', 12B, 12B', known as an articulated table, comprising spray nozzles essentially intended to spray the working rolls 3, 3'. In all, four spray tables 11, 11', 12, 12' are arranged in the roll stand, respectively a lower spray table 11 at the inlet to the roll stand and a lower spray table 12 at the outlet from the roll stand, making it possible to spray the lower part of the strip 2 and the lower working roll 3, and an upper spray table 11' at the inlet to the roll stand and an upper spray table 12' at the outlet from the roll stand, making it possible to spray the upper part of the strip 2 and the upper working roll 3'. In additional to their spray function, the spray devices have a guidance and protection function. In fact, the fixed tables at the inlet to the roll stand make it possible to guide an upstream end of a strip to be rolled when it enters the roll stand, while protecting the rolling mill rolls and the spray nozzles positioned at the inlet or outlet of the roll stand against damage which might be caused, for example, by buckling of a sheet or breakage of a strip.

In current practice, it is necessary to undertake periodic cleaning/replacement or inspection of the spray nozzles on each spray table. Unfortunately, the spray devices known to a person skilled in the art do not provide for easy access to said spray nozzles or for easy maintenance inspection of the equipment. In fact, even after dismantling the rolls from the roll stand, the design of the spray table hinders any easy access to the spray nozzles on said fixed part of the spray table. Thus, the inspection or cleaning/replacement of the spray nozzles in spray systems known to a person skilled in the art, and the maintenance in general of said spray systems, are complex maintenance operations, lengthy to perform, and thus economically unfavorable. Furthermore, the spray tables known to a person skilled in the art have another disadvantage, which is low rigidity resulting from their cantilevered assembly.

BRIEF SUMMARY OF THE INVENTION

An object of the present invention is to propose a spray device for a multi-roll roll stand for cold-rolling a metal strip capable of resolving the above mentioned disadvantages, while guaranteeing guidance of the strip and protection of the rolling mill rolls and spray nozzles and very significant enhancement of the maintenance needed for the productive operation of the rolling mill.

For this purpose, a new kind of spray device and a method for removing/inserting said spray device from/into the roll stand are proposed by the content of the main claims.

A set of sub-claims also presents advantages of the invention.

The present invention relates to a spray device comprising a plurality of nozzles for lubricating and cooling the air gap of a multi-roll roll stand for rolling metal strips, characterized in that said spray device comprises a fixed spray table of elongated shape configured to be rigidly connected to, and in particular resting on, a plurality of mounting plates in a row of bearing rolls of said roll stand;

said fixed spray table comprising a fluid-dispensing network for routing a spray fluid towards said nozzles for said lubricating and said cooling of the strip and/or of said air gap, a connector for connecting said fluid-dispensing network to a network for supplying said fluid, and attachment means, distributed in particular across its width, for rigidly connecting the table, in particular locally, to said mounting plates, preferably to the end mounting plates of said fixed table. Preferentially, said connector is mounted on the motor side when said fixed table is mounted in the roll stand, but such a connector can also be mounted at each end of said fixed table. This involves for example a rapid connector, for example of the telescoping cannula type. By motor side, reference is made to the side of the roll stand opposite which in particular the motors driving the rolling rolls are positioned, as opposed to the operator side where an operator is located.

Preferentially, said spray device according to the invention comprises an articulated table of elongated shape, which can be fitted, in particular by sliding, into a groove, for example cylindrical, rectilinear, arranged on one side of said fixed table, on at least preferential zones of its entire length. In particular, said articulated table comprises nozzles for spraying at least one working roll, and preferentially, also for spraying adjacent intermediate and bearing rolls in the roll stand, a dispensing network for said fluid for routing said spray fluid towards said nozzles of the articulated table for said lubricating and said cooling of said working roll and preferentially, also for spraying adjacent intermediate and bearing rolls, and at least one connector for connecting its dispensing network (112) to said network for supplying fluid. For this purpose, said articulated table, and thus its nozzles, are in particular adjustable in position by a system for controlling the movement of said articulated table, so as to be able to be directed mainly in the direction of said working roll, and preferentially, also in the direction of said intermediate rolls when said articulated table is mounted in said roll stand. Preferentially, the dispensing network for said spray fluid in said fixed table is independent of the dispensing network for said spray fluid of the articulated table. Furthermore, the connector of each dispensing network for said spray fluid is in particular capable of being automatically coupled to said network for supplying said spray fluid during the insertion of said row of bearing rolls and/or the articulated table into said roll stand and/or the closure of a door on the operator side of the frame of the roll stand, and conversely, of being automatically uncoupled from the supply network during dismantling of said row of bearing rolls or of said articulated table and/or opening of said door in the frame of the roll stand.

In particular, said articulated table comprises at least at one of its ends, in particular positioned on the motor side when it is mounted in said roll stand, a means for coupling to a system, for example mechanical, for transmitting a command for the movement, for example motorized, of said articulated table, said movement command originating from said movement control system, positioned preferentially on the outside of the roll stand on the motor side. Preferentially, said means for coupling to said transmission system is capable of automatically coupling said supply network to said dispensing network for spray fluid of said articulated table.

Furthermore, said means for coupling the articulated table and its interlocking with said fixed table advantageously provide for removal of the fixed table, in particular in upper position, out of the roll stand, and respectively its insertion into the roll stand, independent of removal, respectively independent of insertion, of said articulated table out of, respectively into, said roll stand, and vice versa. Thus, the dismantling or assembly of the fixed table and the articulated table are preferentially independent of one another and can be performed easily. In particular, after coupling a device for removing a row of bearing rolls to a device for coupling said fixed table of said spray device or to a device for coupling said bearing shaft, said fixed table can be removed or mounted simultaneously with said row of bearing rolls to which it is fixed by longitudinal sliding of said row of bearing rolls out of the roll stand or longitudinal sliding into the roll stand in the case of insertion. In particular, said fixed table may comprise, at one of its ends, in particular on the operator side when said spray device is mounted in the roll stand, said coupling device suitable for coupling the fixed table of the spray device to the device for removing said row of bearing rolls. Thus, the removal/insertion of a row of bearing rolls according to the invention makes it possible simultaneously to remove said fixed table, in particular in upper positions, from the spray device according to the invention.

The fixed table is preferentially intended to spray the strip, when entering or leaving the roll stand, and has in particular a geometry suitable for rigid attachment to said mounting plates, but also, preferentially, said geometry is suitable for being supported by said mounting plates. Preferentially, said attachment means are distributed, for example uniformly, across the width of said fixed table, or preferentially solely on the end mounting plates of the row of bearing rolls. According to a preferential embodiment, only the end mounting plates of the row of bearing rolls are rigidly connected to said fixed table, while each of the other mounting plates of said row of bearing rolls is simply in contact with or resting on said fixed table, so as to strengthen its rigidity. Advantageously, the rigid connection of the fixed table of the spray device to the mounting plates provides for said simultaneous removal of the assembly formed by the row of bearing rolls and said fixed table. Furthermore, said rigid connection of said fixed table to said mounting plates thanks to said attachment means makes it possible to stiffen said fixed table, since the latter comprises several bearing and fixing points not only along its length, but also across all of its width.

The present invention also relates to a row of bearing rolls comprising a plurality of bearing rolls and mounting plates mounted, for example alternating, on a single roll-bearing shaft, each bearing roll being in particular edged by two mounting plates, said row of bearing rolls being intended to take up the rolling forces resulting from a multi-roll roll stand, for example of the 12- or 20-High type, characterized in that it comprises said spray device according to the invention for lubricating and cooling the strip and/or the air gap of said roll stand and as described above. Advantageously, said mounting plates can thus act not only as a support for said bearing shaft for the bearing rolls, but also for the spray device according to the invention, in particular for said fixed table and/or said articulated table of said spray device. In particular, each row of bearing rolls of the roll stand the side of which is directly opposite the strip can be fitted with said fixed table. The latter is in particular capable of being rigidly connected to said side directly opposite the strip so as to be as close as possible to the latter. For example, in the case of a 20-High roll stand, the mounting plates of the rows of bearing rolls furthest upstream and furthest downstream of the roll stand are fitted with the spray device according to the invention.

Preferentially, the mounting plates of said row of bearing rolls are configured to be linked by two plates with adjacent surfaces intended to rest on the frame of the roll stand, said plates having adjacent surfaces forming in particular an angle close to 90° with one another, and providing for, among other things, on the one hand an overall increase in the rigidity of said row of bearing rolls and, on the other hand, removal or insertion of said row of bearing rolls and the spray device by longitudinal movement, in particular by sliding out of or sliding into the roll stand by means of a removal device which can be coupled to the device for coupling said fixed table. Also, the integration of a fixed table into said row of bearing rolls makes it possible to facilitate the assembly/dismantling of the upper rows of bearing rolls, since said fixed table in particular for the upper positions can in particular comprise a bearing zone in the low part, i.e. the part close to the strip when said fixed table is fixed to said mounting plates in the roll stand, said bearing zone comprising in particular at least one longitudinal guide in the shape of a groove for the lateral guidance of said row of rolls fitted with the spray device, said groove 111 being able for example to act as said guide, and a flat bearing surface to support said row of bearing rolls during its removal or insertion by means of a device for removing a row of bearing rolls, said guide being capable of interacting with a part of said removal device having a shape complementary to said guide.

The present invention also claims a roll stand with multiple rolls, for example of the 12- or 20-High type, comprising at least one row of bearing rolls as described above. Preferentially, such a roll stand also comprises said control system for said movement of said articulated table, said control system being in particular positioned on the motor side, outside said roll stand and fixed to the door on the motor side of the frame of the roll stand. The positioning on the motor side of the control system advantageously makes it possible, with respect to the prior art, to avoid a stage of dismantling/assembling actuators of said control system located preferentially on the operator side and intended to control the movement of the articulated table and hoses intended to feed the dispensing network (112) of said articulated table during the dismantling/assembly of the spray device or rows of bearing rolls. Furthermore, said positioning also frees space on the operator side and increases the visibility of the strip when the stand is open.

Finally, the present invention also relates to a method for removing, respectively inserting, a spray device as described above, characterized in that it comprises:

coupling a device for removing a row of bearing rolls to a coupling device of said fixed table of said spray device or to a coupling device of a bearing shaft of said row of bearing rolls, said coupling device of said fixed table or of said bearing shaft being suitable for providing for removal of said row of bearing rolls by longitudinal movement, i.e. parallel to said bearing shaft;

removal, respectively insertion of said fixed table, by removal, respectively insertion of said row of bearing rolls according to the invention by means of said removal device, by longitudinal movement out of the roll stand, respectively by longitudinal movement into the roll stand, of said row of bearing rolls according to the invention, said movement possibly being for example sliding out of or into said stand of said row of bearing rolls performed by said removal device installed for example outside the stand. In particular, said method for removing, respectively inserting, said spray device is also characterized in that it comprises automatic disconnection, respectively connection, of a dispensing network for spray fluid of said spray device to a network for supplying said spray fluid;

optionally, removal of said articulated table, and insertion of it, by movement along its longitudinal axis, for example by sliding, in said groove of said fixed table, in particular by said removal device, and for example simultaneously with the removal/insertion in stand of said row of bearing rolls.

BRIEF DESCRIPTION OF THE SEVERAL VIEWS OF THE DRAWING

Exemplary embodiments and applications provided using the following figures will help give a better understanding of the present invention.

DESCRIPTION OF THE INVENTION

Figure 1:
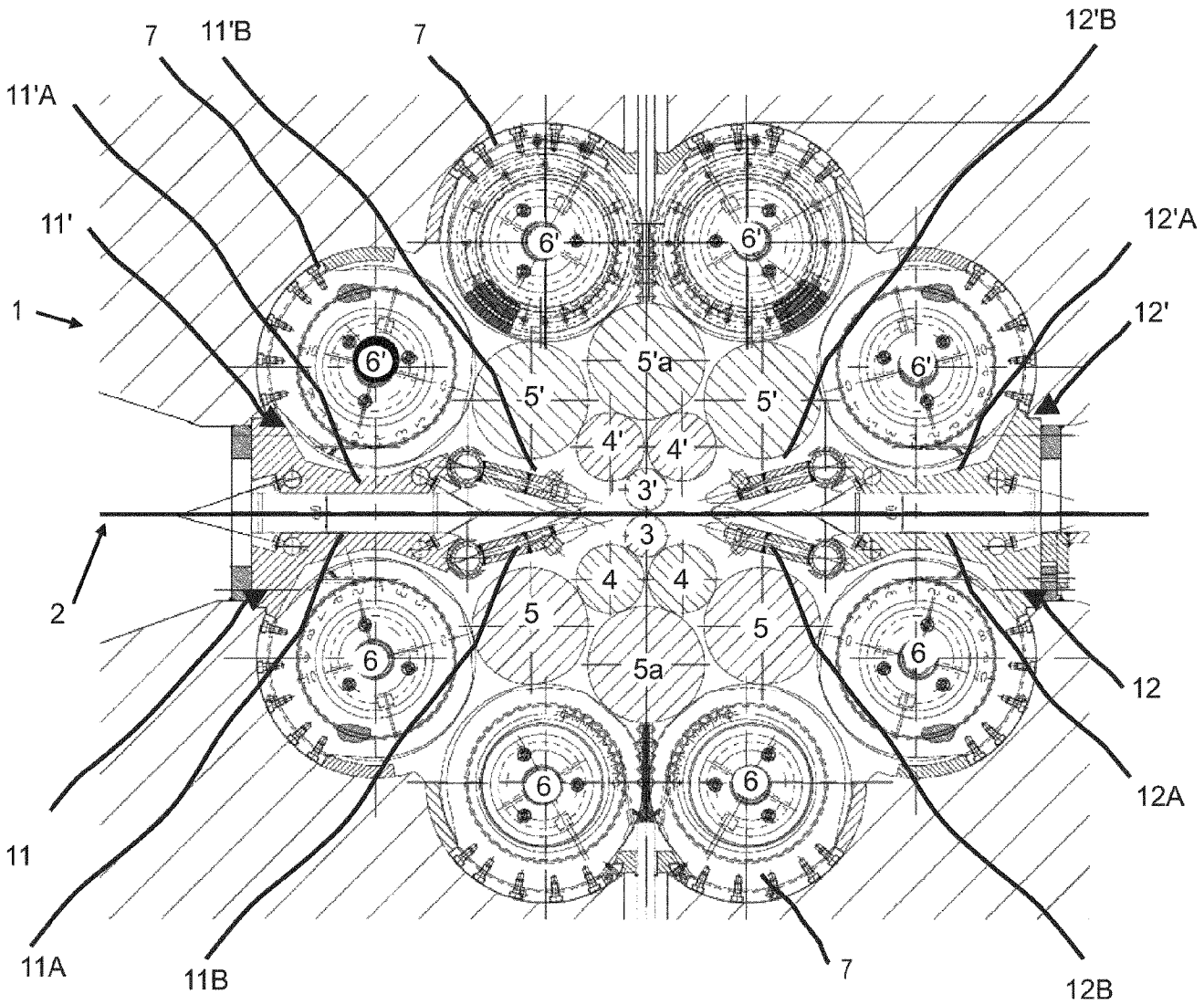
FIG. 1 example of a spray device for a rolling mill of the 20-High type according to the prior art.

As an example, FIG. 1 presents a sectional view of a rolling mill of the 20-High type comprising a spray device 11, 11', 12, 12' according to the prior art. A working roll 3, 3' in contact with a strip 2 to be rolled is supported by two intermediate bearing rolls 4, 4', themselves supported by three intermediate bearing rolls 5, 5*a*, 5', 5'*a*, themselves supported by four rows of bearing rolls 6, 6', each row of bearing rolls being made up of a plurality of bearing rolls and mounting plates 7 mounted alternating on a single bearing shaft supported by said mounting plates 7.

Figure 2:
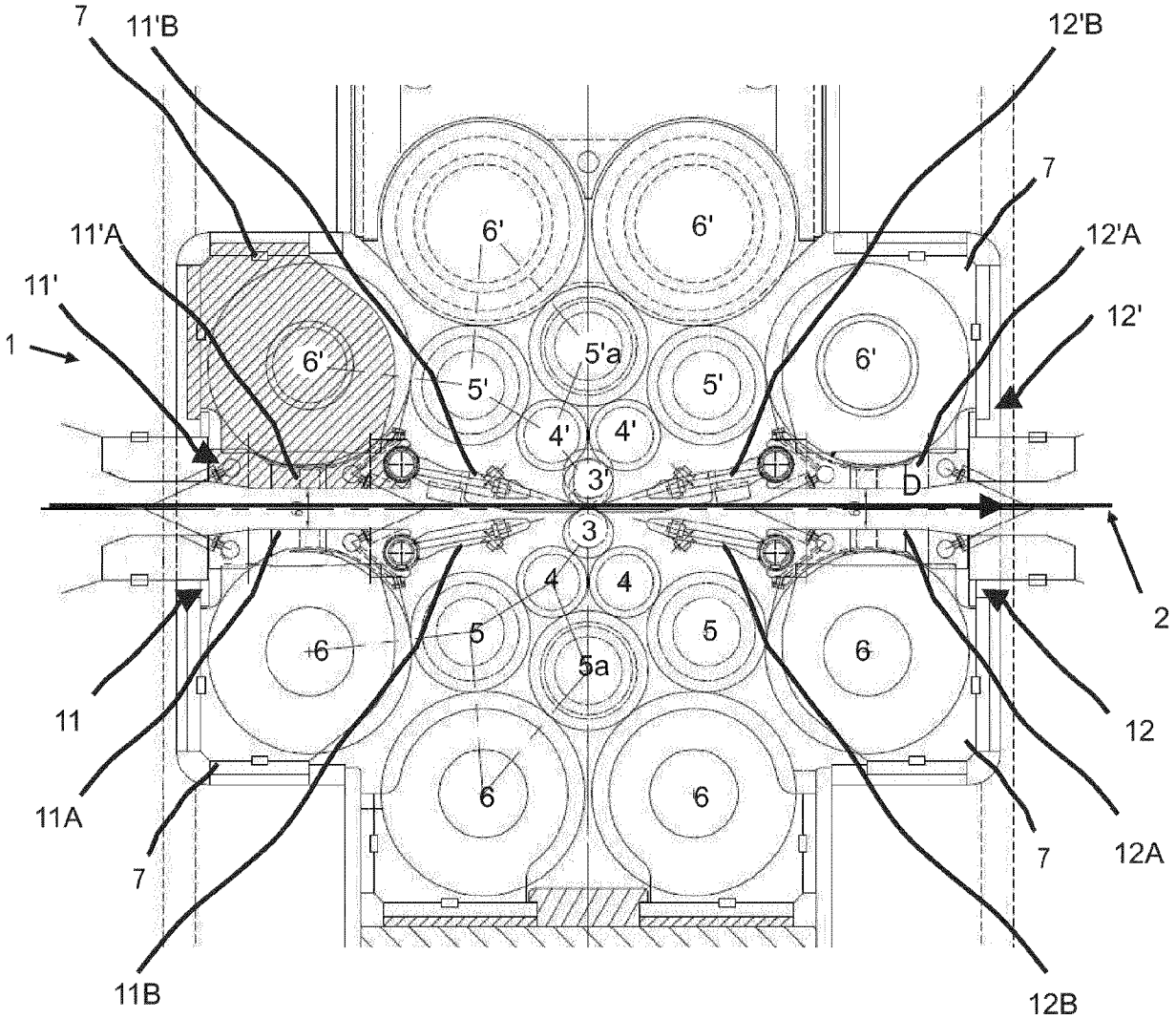
FIG. 2 exemplary embodiment of a rolling mill of the 20-High type according to the invention.

FIG. 2 presents a sectional view of an exemplary embodiment of a rolling mill of the 20-High type comprising a spray device according to the invention, using the same references as those used for FIG. 1. Unlike FIG. 1, the upper spray device 11' and the lower spray device 11 arranged at the input to the rolling stand are fixed respectively to the mounting plates 7 of the upper row of bearing rolls and to the mounting plates 7 of the lower row of bearing rolls situated furthest upstream with respect to the direction of travel D of the strip. Similarly, the upper spray device 12' and the lower spray device 12 arranged at the output from the roll stand are fixed respectively to the mounting plates 7 of the upper row of bearing rolls and to the mounting plates 7 of the lower row of bearing rolls situated furthest downstream with respect to the direction of travel D of the strip.

Figure 3:
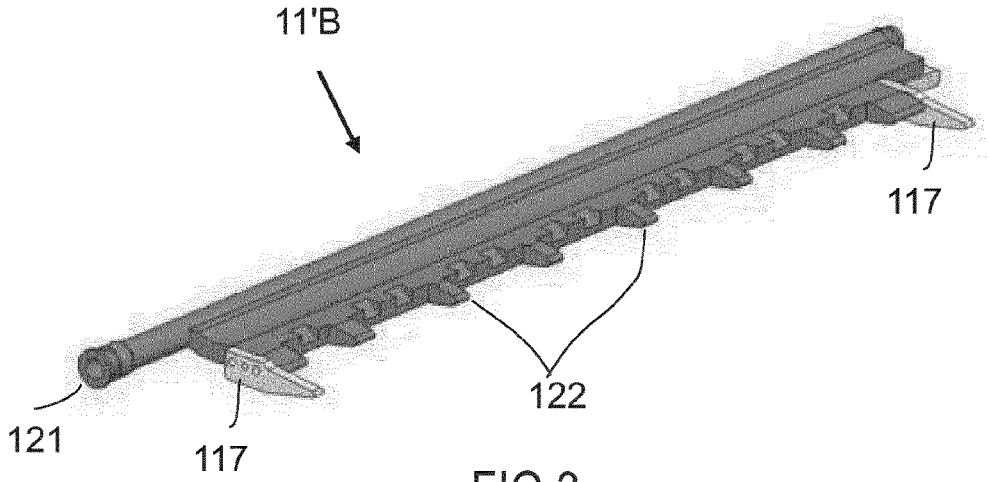
FIG. 3 exemplary embodiment of an articulated table of a spray device according to the invention.

FIG. 3 shows an exemplary embodiment of an articulated table 11'B of a spray device according to the invention, comprising a dispensing network 121 for spray fluid comprising in particular at least one part capable of being fitted into said groove 111 (see for example FIG. 4) of said fixed table 11'A. Said articulated table 11'B also comprises a plurality of nozzles 122 distributed along the entire length of the articulated table, i.e. across the width of the roll stand, and intended to spray at least one working roll 3, 3' and adjacent intermediate bearing rolls 4, 4', 5, 5', 5*a*, 5'*a*, 6, 6'. Preferentially, said articulated table 11'B also comprises, at each of its ends, a bracket 117 to support an upper working roll 3', said brackets 117 of the articulated table being capable of acting as a support for the upper working roll 3', in particular during assembly or dismantling of the rolling mill rolls or other operations requiring individual lifting of the upper working roll 3'.

Figure 4:
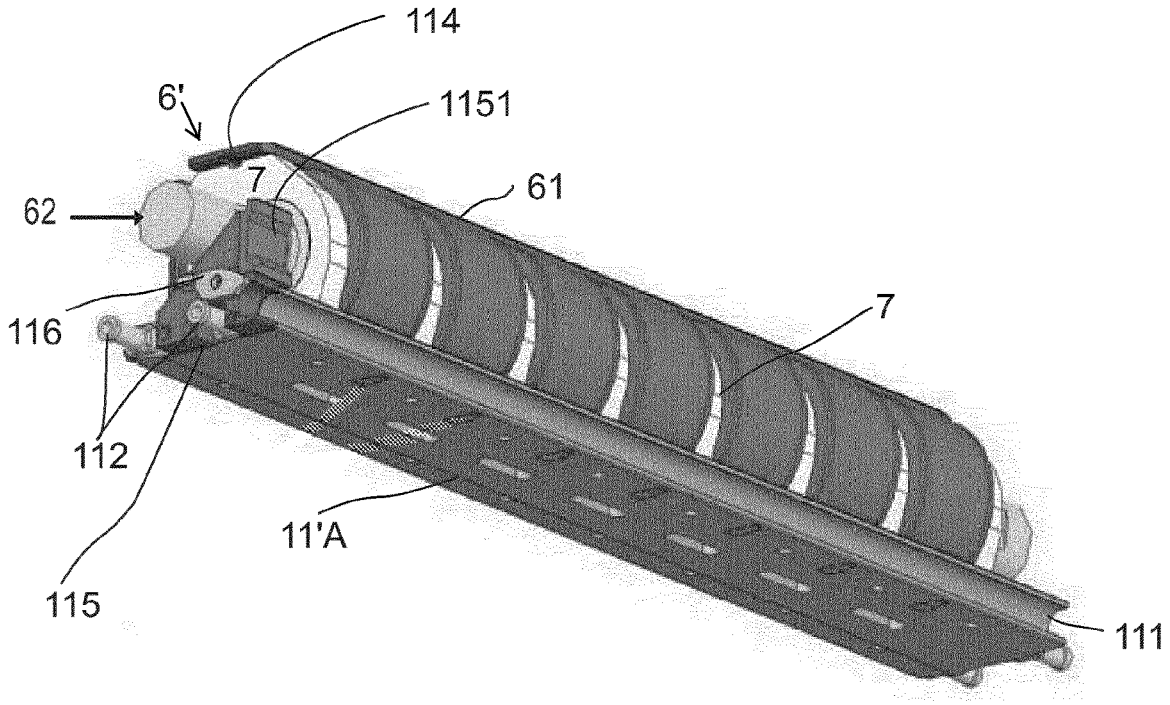
FIG. 4 exemplary embodiment of an upper row of bearing rolls including a spray device according to the invention (bottom view).
Figure 5:
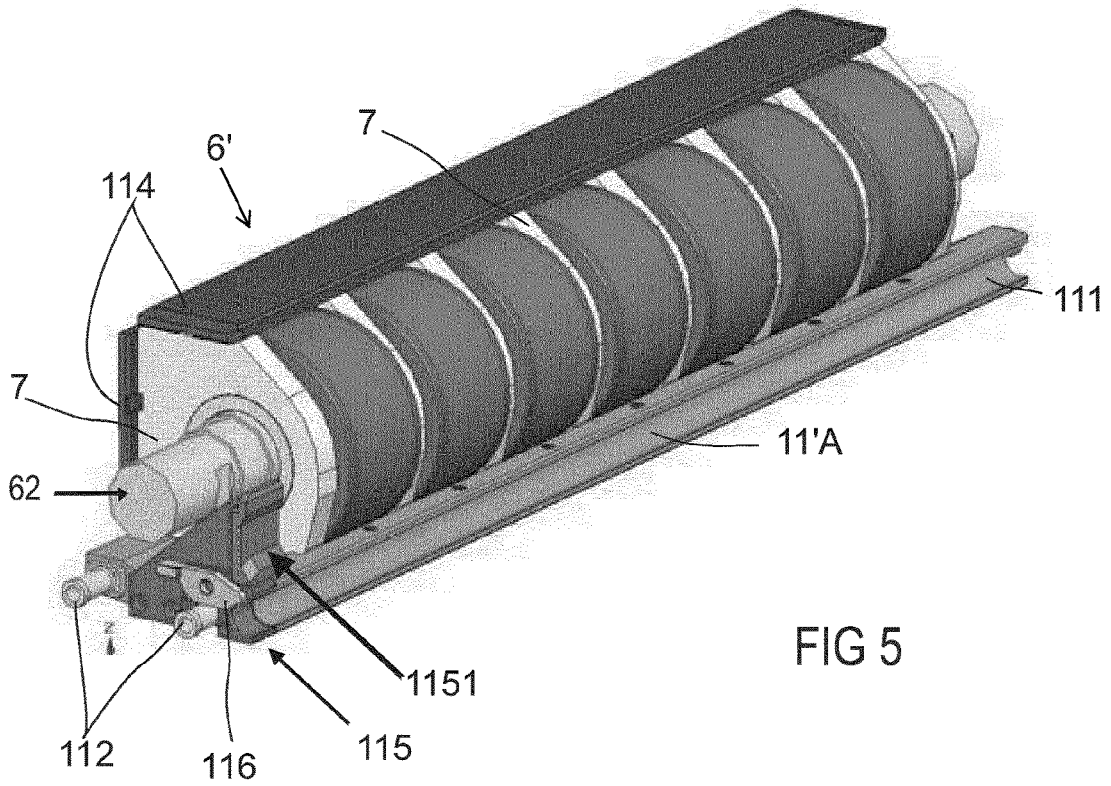
FIG. 5 exemplary embodiment of an upper row of bearing rolls including a spray device according to the invention (top view).

FIGS. 4 and 5 present exemplary embodiments of a row of bearing rolls 6' on the stand input side with respect to the direction of rolling "D" including a spray device according to the invention, bottom view (FIG. 4) and top view (FIG. 5). Said row of bearing rolls 6' comprises a plurality of bearing rolls 61 and mounting plates 7 mounted alternating on a single roll bearing shaft 62, each bearing roll being in particular edged by two mounting plates. Each row of bearing rolls 6, 6' is also positioned and fixed to the frame 1 of the roll stand by means of said plates 114 and of said mounting plates 7 mounted alternating on a bearing shaft 62 and which provide for take-up of the forces resulting from rolling by the working rolls. Said mounting plates are fixed to a fixed table 11'A of a spray device according to the invention. This fixed table 11'A comprises a dispensing network 112 of spray fluid providing for the supply of spray fluid to nozzles 112 distributed opposite the strip when said row of bearing rolls 6 is mounted in the roll stand. Said row of bearing rolls 6 comprises in particular two plates 114 linking said mounting plates together and each intended to rest on the frame of the roll stand. Each fixed table 11'A comprises in particular, at one of its ends, a coupling device 115 suitable for coupling the fixed table of the spray device to a device for removing said row of bearing rolls. Preferentially, said coupling device 115 comprises a supporting hook element 1151 comprising a bearing zone for the chocks on the operator side of the upper motorized intermediate rolls 5' illustrated in FIGS. 1 and 2. Advantageously, before the operation to remove an intermediate roll 5', said roll 5' remains suspended by the chock on the operator side, which can rest on said supporting hook element 1151 while being held, on the motor side, by an extension sleeve acting so as to transmit the motor torque. Said coupling device 115 also comprises in particular an axial retention bolt 116 for the articulated table, in particular intended to prevent any axial movement of said articulated table when opening a door in the roll stand on the operator side.

Figure 6:
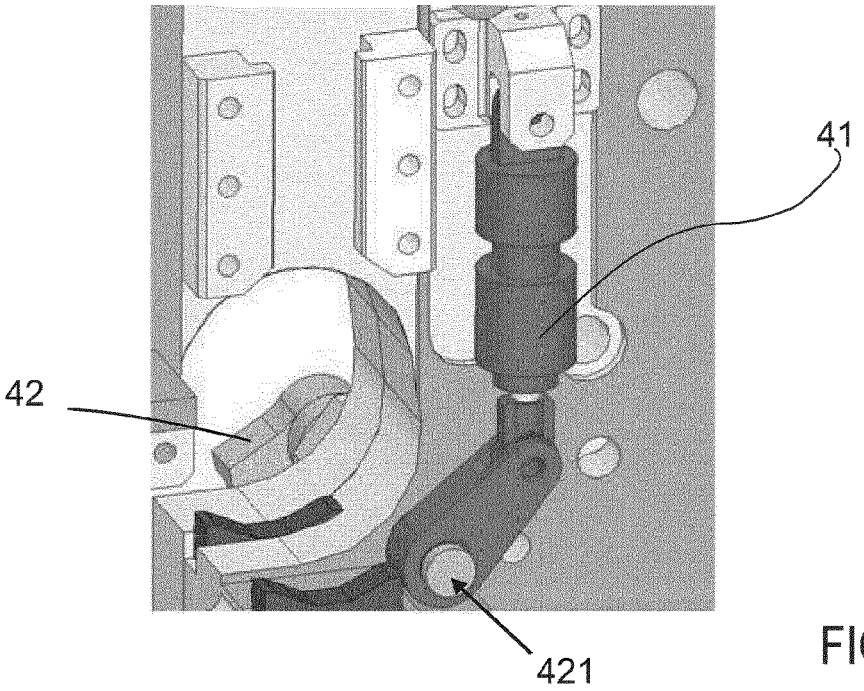
FIG. 6 view of a part of the external face of a roll stand on the motor side according to the invention comprising an exemplary embodiment of a control and transmission system for movement of an articulated table.
Figure 7:
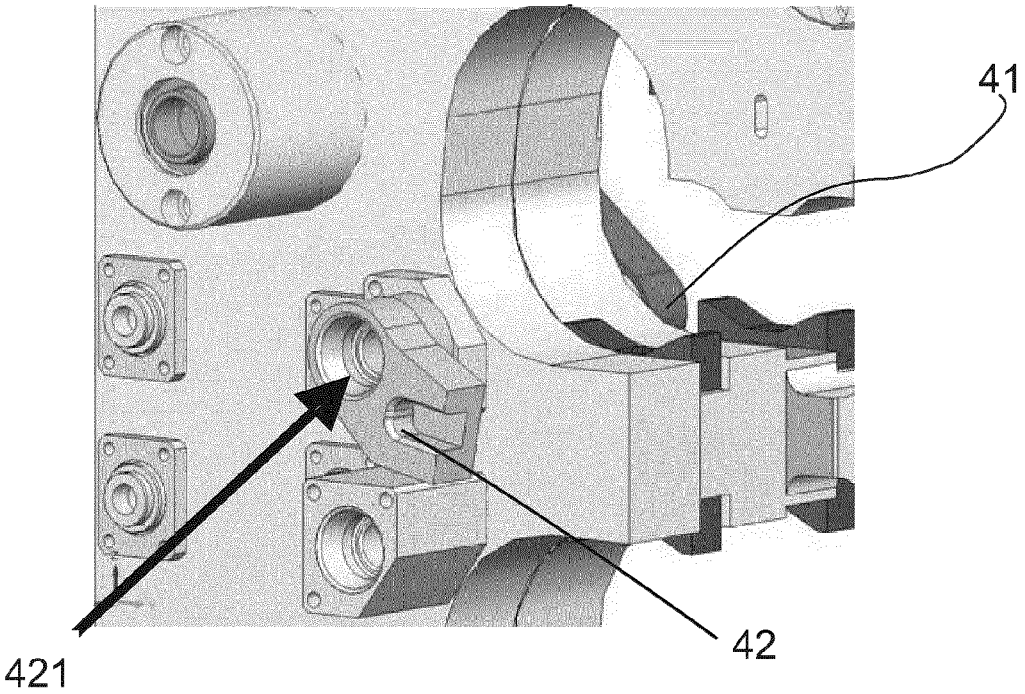
FIG. 7 view of a part of the internal face of a roll stand on the motor side according to the invention comprising an exemplary embodiment of a control and transmission system for movement of an articulated table.

FIGS. 6 and 7 are respectively a view of a part of the external, respectively internal face, on the motor side, of a preferential embodiment of a roll stand according to the invention. An exemplary embodiment of a control system 41 is in particular fixed to the outside of the roll stand, on an external face of the wall of the roll stand or of the door of the roll stand, on the motor side, and is coupled to a transmission system 42 providing for movement of the articulated table. The control system 41 comprises in particular an actuator the stem of which is coupled to a shaft 421 of said transmission system 42, said shaft 421 passing from one side to the other of the wall of the roll stand so as to transmit towards the interior of the roll stand a movement of said stem of said actuator reflecting a command for movement of the articulated table by the control system 41. Said shaft 421 being in particular hollow so as to permit routing of said spray fluid towards the dispensing network of the articulated table, in particular permitting the connection of said dispensing network of the articulated table to said network for routing said spray fluid. Said transmission system 42 can preferentially be automatically coupled to a means for coupling said articulated table so as to transmit to it said movement of the actuator stem.

The invention claimed is:

1. A spray device, comprising:

an articulated table having a plurality of nozzles directed to spray at least one working roll of a roller stand with multiple rollers for rolling a metal strip; and a fixed spray table of an elongated shape rigidly connected to a plurality of mounting plates in a row of bearing rollers of the roller stand, said fixed spray table having a plurality of nozzles;

said fixed spray table having a fluid-dispensing network for routing a fluid toward said plurality of nozzles of said fixed spray table, said plurality of nozzles of said fixed spray table distributed across the row of bearing rollers and directed to spray the fluid toward at least one of the metal strip or an air gap of the roller stand at a location adjacent the bearing rollers;

said articulated table pivotally attached to said fixed spray table;

wherein said at least one working roll that said plurality of nozzles of said articulated table are directed to spray is not one of the bearing rollers.

2. The spray device according to claim 1, wherein:

said fixed spray table has a side with a rectilinear groove formed therein; and said articulated table has an elongated shape and is fitted into said rectilinear groove.

3. The spray device according to claim 2, wherein said articulated table has a dispensing network for the fluid.

4. The spray device according to claim 3, wherein said fluid-dispensing network of said fixed spray table has a connector capable of being coupled to a network for supplying the fluid to be sprayed when the row of bearing rollers or said articulated table is inserted into the roller stand and said dispensing network of said articulated table has a connector capable of being coupled to the network for supplying the fluid to be sprayed when the row of bearing rollers or said articulated table is inserted into the roller stand.

5. The spray device according to claim 2, wherein said articulated table contains, at least at one of its ends, a coupler for coupling to a transmission system for transmitting a command for a movement of said articulated table.

6. The spray device according to claim 5, wherein said articulated table has a fluid dispensing network, and said coupler for coupling to the transmission system is capable of coupling a network for supplying the fluid to said fluid dispensing network of said articulated table.

7. The spray device according to claim 1, wherein said fixed spray table has an end with a coupling device.

8. A row of bearing rollers of a roller stand, comprising:
mounting plates;
a plurality of bearing rollers;
a single roller-bearing shaft, said bearing rollers and said mounting plates mounted on said single roller-bearing shaft; and
a spray device having an articulated table having a plurality of nozzles directed to spray at least one roller of the roller stand other than one of said plurality of bearing rollers;
said spray device further having a fixed spray table of an elongated shape rigidly connected to said mounting plates, said fixed spray table having a plurality of nozzles;
said fixed spray table having a fluid-dispensing network for routing a fluid toward said plurality of nozzles of said fixed spray table, said plurality of nozzles of said fixed spray table distributed across said plurality of bearing rollers and directed to spray the fluid toward at least one of a metal strip or an air gap of the roller stand at a location adjacent said plurality of bearing rollers; and
said articulated table pivotally attached to said fixed spray table.

9. The row of bearing rolls according to claim 8, wherein said mounting plates are configured to act as a support having two plates with adjacent surfaces intended to rest on a frame of the roller stand, said adjacent surfaces forming an angle of 90° with one another.

10. A multi-roller roller stand, comprising:
multiple rolling rollers for rolling a metal strip;
a network for supplying a fluid; and
a row of bearing rollers, including:
mounting plates;
a plurality of bearing rollers;
a single roller-bearing shaft, said bearing rollers and said mounting plates mounted on said single roller-bearing shaft;
a spray device having an articulated table having a plurality of nozzles directed to spray at least one of said multiple rollers;
said spray device further having a fixed spray table of an elongated shape rigidly connected to said mounting plates, said fixed spray table having a plurality of nozzles;
said fixed spray table having a fluid-dispensing network for routing a fluid toward said plurality of nozzles of said fixed spray table, said plurality of nozzles of said fixed spray table distributed across said plurality of bearing rollers and directed to spray the fluid toward at least one of the metal strip or an air gap of the roller stand at a location adjacent said plurality of bearing rollers; and
said articulated table pivotally attached to said fixed spray table.

11. The multi-roller roller stand according to claim 10, further comprising:
a frame; and
a control system;
said control system for controlling a movement of said articulated table, said control system fixed to said frame.

* * * * *